United States Patent [19]

Johnson

[11] 4,418,710

[45] Dec. 6, 1983

[54] PILOT CONTROL VALVE FOR LOAD SENSING HYDRAULIC SYSTEM

[75] Inventor: Oliver W. Johnson, Chaska, Minn.

[73] Assignee: Eaton Corporation, Cleveland, Ohio

[21] Appl. No.: 308,347

[22] Filed: Oct. 5, 1981

[51] Int. Cl.[3] ..... F15B 13/06

[52] U.S. Cl. ..... 137/117; 91/516; 91/518; 137/625.16

[58] Field of Search ..... 91/516, 518; 137/117, 137/625.13, 625.15, 625.16

[56] References Cited

U.S. PATENT DOCUMENTS 3,455,210 7/1969 Allen .
3,971,216 7/1976 Miller .
4,167,893 9/1979 Johnson .
4,199,942 4/1980 Kasper .

*Primary Examiner*—Gerald A. Michalsky
*Attorney, Agent, or Firm*—C. H. Grace; L. J. Kasper

[57] ABSTRACT

A pilot control valve (35) is provided for use in a load sensing system including a priority flow control valve (21). The pilot valve includes a flow orifice (47) through which passes flow from the priority outlet port (23) to the motor (13). The pilot valve includes a valve sleeve (73) and a relatively rotatable valve spool (75). This valving controls fluid communication between the load signal port (49) and the system reservoir and main flow path, upstream and downstream of the flow orifice. Movement of the valve spool from a minimum flow position to a maximum flow position progressively varies the load signal (51) from reservoir pressure to system pressure, thus causing the output of the priority valve (21) to progressively increase from a minimum flow to a maximum flow.

5 Claims, 14 Drawing Figures

PILOT CONTROL VALVE FOR LOAD SENSING HYDRAULIC SYSTEM

BACKGROUND OF THE DISCLOSURE

The present invention relates to controls for load sensing hydraulic systems, and more particularly, to a pilot control valve for use in such a system.

As the use of hydraulic systems has increased, the recent interest in energy conservation and improved system performance has resulted in the development and adoption of load sensing hydraulics, i.e., hydraulic systems in which the load imposed on the system is sensed and the "load signal" is used to match the output of the fluid delivery source to the demand for fluid. Such systems minimize the pump horsepower typically wasted in the older, open-center hydraulic systems. From the standpoint of system performance, the use of load sensing insures that the flow through the system, for a given position of the main control valve, will remain fairly constant, regardless of variations in load imposed on the system.

Typical load sensing systems now in commercial use conform generally to U.S. Pat. No. 3,455,210, assigned to the assignee of the present invention. Such systems normally include a load sensing, priority flow control valve which receives a load signal and ports sufficient fluid to the priority load circuit to maintain a constant pressure differential across the main flow control orifice of the priority load circuit, as the load varies, thus keeping system flow constant.

The prior art has attempted to optimize the use of load sensing systems and priority flow control valves by providing for certain modifications of the load signal under various operating conditions, for example, increasing the load signal artificially at maximum valve deflection to increase system gain and thus increase system flow in a manner which is disproportionate to the valve displacement.

The prior art has also attempted to perform limited control of the system flow by selectively varying the load signal over a range from its natural pressure all the way down to reservoir pressure. In these various types of prior art systems, it was still intended to include a main manual control valve, in addition to the priority flow control valve. The main control valve would still be used, at least part of the time, to perform its conventional flow and direction control function. As is well known, such control valves (e.g., standard "spool" valves), are generally large and require substantial manual input force to achieve valve movement and control of system flow.

Accordingly, it is an object of the present invention to provide a flow control arrangement for a load sensing hydraulic system which eliminates the need for the conventional, large, main flow control valve.

It is another object of the present invention to provide such a flow control arrangement in which the load sensing priority valve effectively operates as the main flow control valve as a result of variations in the load signal which controls the priority valve.

It is a more specific object of the present invention to provide a flow control arrangement including a pilot control valve for selectively varying the load signal over a range of pressures from system reservoir pressure to maximum system pressure, to vary system flow from a minimum flow rate to a maximum flow rate.

It is a related object of the present invention to provide a flow control system which is capable of controlling relatively large flow rates by means of a relatively small pilot control valve, actuation of which requires substantially less input power than in prior art flow control systems.

The above and other objects of the present invention are accomplished by the provision of an improved flow control arrangement for use in a system including a fluid source having output flow which is variable in response to changes in pressure in a load signal chamber. The system also includes a flow path, including a flow orifice, connected in series flow relationship with the fluid source. The improved flow control arrangement comprises a valve housing defining a valve bore, a feed passage in fluid communication with the flow path, upstream of the flow orifice, and a load passage in fluid communication with the flow path, downstream of the flow orifice. The valve housing further defines a load signal passage in fluid communication with the load signal chamber, and a drain passage in fluid communication with the system drain. The feed, load, load signal, and drain passages are in fluid communication with the valve bore.

A movable valve member is disposed in the valve bore and had a plurality of control positions. In a first position, the valve member provides fluid communication between the drain passage and the load signal passage while blocking communication through the feed and load passages. In a second position, simultaneous communication is provided between the load signal passage and the drain and load passages while blocking communication through the feed passage. In a third position, the valve member provides communication between the load signal passage and the load passage while blocking communication through the drain and feed passages. A fourth position provides simultaneous communication between the load signal passage and the load and feed passages while blocking communication through the drain passage. In a fifth position the valve member provides fluid communication between the load signal passage and the feed passage while blocking communication through the drain and load passages.

In a preferred embodiment of the invention, as the valve member moves from the first position, through the second, third, and fourth positions to the fifth position, the flow through the flow path progressively increases from a minimum flow to a maximum flow, although not necessarily in a precisely linear manner.

DESCRIPTION OF THE PREFERRED EMBODIMENT

Figure 1:
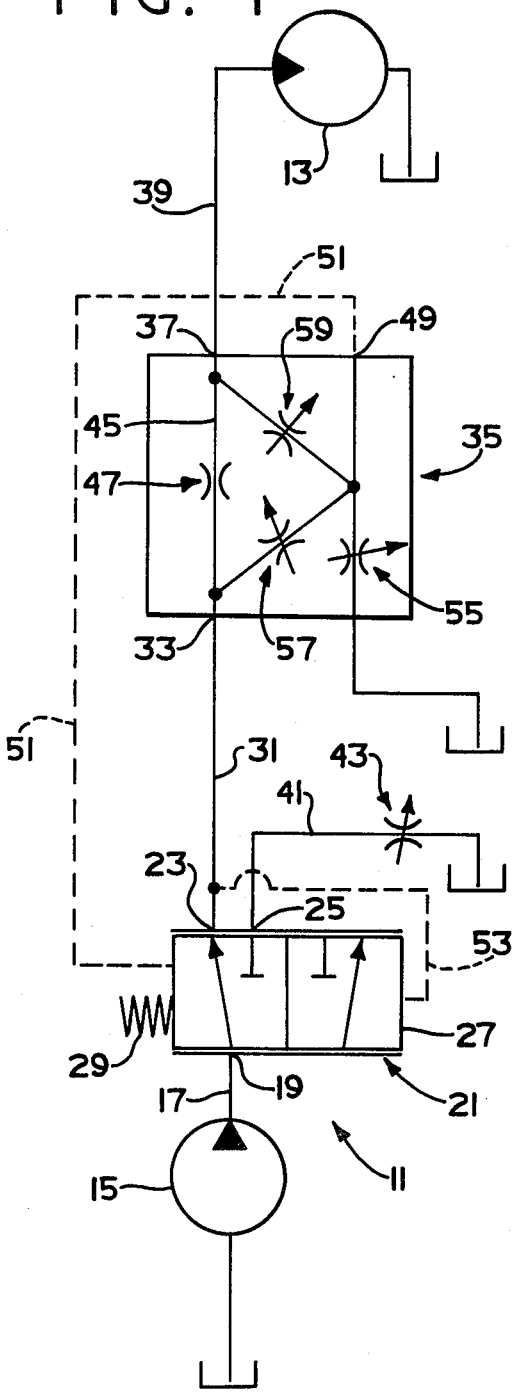
FIG. 1 is a hydraulic schematic of a preferred embodiment of the present invention.

Referring now to the drawings, which are not intended to limit the invention, FIG. 1 illustrates schematically a system for controlling the flow of fluid from a fluid source, generally designated 11 to a fluid pressure operated device, shown herein as a motor 13.

The fluid source 11 includes a fluid pump 15, the output of which is fed by means of a conduit 17 to an inlet port 19 of a priority flow control valve generally designated 21. The flow control valve 21 also includes a priority outlet port 23, an excess flow outlet port 25, a movable valve member 27, and a spring 29 which biases the valve member 27 toward the position shown in FIG. 1. In the position shown in FIG. 1, there is substantially unrestricted fluid communication between the inlet port 19 and the priority outlet port 23, while the excess flow outlet port 25 is blocked from communication with the inlet port 19. It should be appreciated that the priority flow control valve 21 may be of the type well known in the art, such as is illustrated in U.S. Pat. No. 3,455,210, assigned to the assignee of the present invention, and incorporated herein by reference.

The priority outlet port 23 is connected by means of a conduit 31 to an inlet port 33 of a pilot control valve, generally designated 35. The pilot control valve 35 includes an outlet port 37 which is connected by means of a conduit 39 to the inlet of the motor 13. The pilot control valve 35 and motor 13 together may be viewed as the priority load circuit. Connected to the excess flow port 25, by means of a conduit 41, is an auxiliary load circuit, represented for simplicity herein as a variable orifice 43.

The pilot control valve 35, which is the essence of the present invention, will be described schematically in connection with FIG. 1. Subsequently, a preferred structural embodiment of the pilot control valve 35 will be described in detail. The pilot valve 35 defines a flow path 45 communicating between the inlet port 33 and outlet port 37. The flow path 45 includes a flow orifice 47, the primary function of which is to generate a pressure drop, the purpose of which will be described subsequently. The pilot valve 35 includes a load signal port 49, with the fluid pressure in the load signal port 49 being transmitted as a load signal 51 to the spring chamber of the priority flow control valve 21, as is now well known in the art. The load signal 51, together with the spring 29, biases the valve member 27 toward the right in FIG. 1 to the position shown. At the same time, a pilot signal 53 is transmitted from the conduit 31 to bias the valve member 27 in the opposite direction, as is also well known in the art.

As is shown schematically in FIG. 1, the load signal port 49 is in fluid communication with the system reservoir through a variable orifice 55. At the same time, the load signal port 49 is in fluid communication with the flow path 45, upstream of the flow orifice 47, through a variable orifice 57, and in fluid communication with the flow path 45 downstream of the flow orifice 47 through a variable orifice 59. These variable orifices 55, 57, and 59, as well as their sequential control, constitute an important aspect of the present invention, which will be described in greater detail subsequently. It should be noted that the system shown schematically in FIG. 1 provides only control of rate of flow to the motor 13, but not control of the direction of flow.

Figure 2:
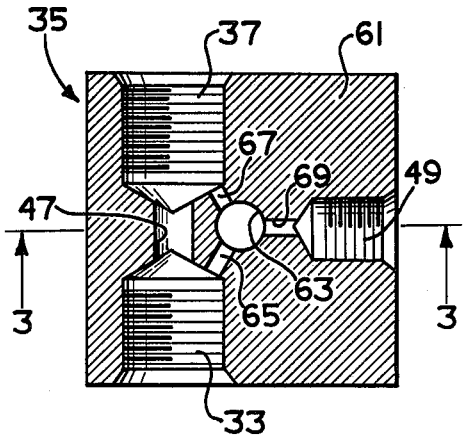
FIG. 2 is a transverse cross section through the pilot control valve shown schematically in FIG. 1.
Figure 3:
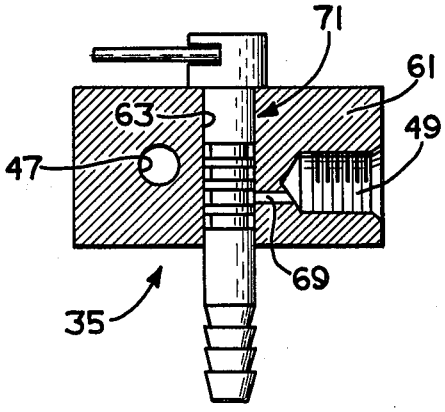
FIG. 3 is an axial cross section taken on line 3—3 of FIG. 2, and on the same scale.

Referring now to FIGS. 2 and 3, in conjunction with FIG. 1, the preferred embodiment of the pilot control valve 35 will be described in structural detail. The pilot valve 35 includes a valve block 61 which defines the inlet port 33, the outlet port 37, the flow orifice 47 and the load signal port 49, which are shown schematically in FIG. 1. The valve block 61 further defines a valve bore 63, a feed passage 65 communicating between the inlet port 33 and the valve bore 63, a load passage 67 communicating between the outlet port 37 and the valve bore 63, and a load signal passage 69 communicating between the load signal port 49 and the valve bore 63. Disposed in the valve bore 63 is a valve spool assembly, generally designated 71, which is shown in FIG. 3, but not in FIG. 2, and which will be described in greater detail in connection with FIGS. 4–7. It should be noted that the passages 65, 67, and 69 are not in the same plane (see FIG. 4) although they are shown in FIG. 2 as being in the same plane for ease of illustration. It should also be noted that the pilot control valve 35 as shown in FIG. 2 has the main flow path (flow path 45 of FIG. 1) integral therewith, but within the scope of the present invention, the flow path 45 and flow orifice 47 may be separate from the rest of the pilot control valve 35.

Figure 4:
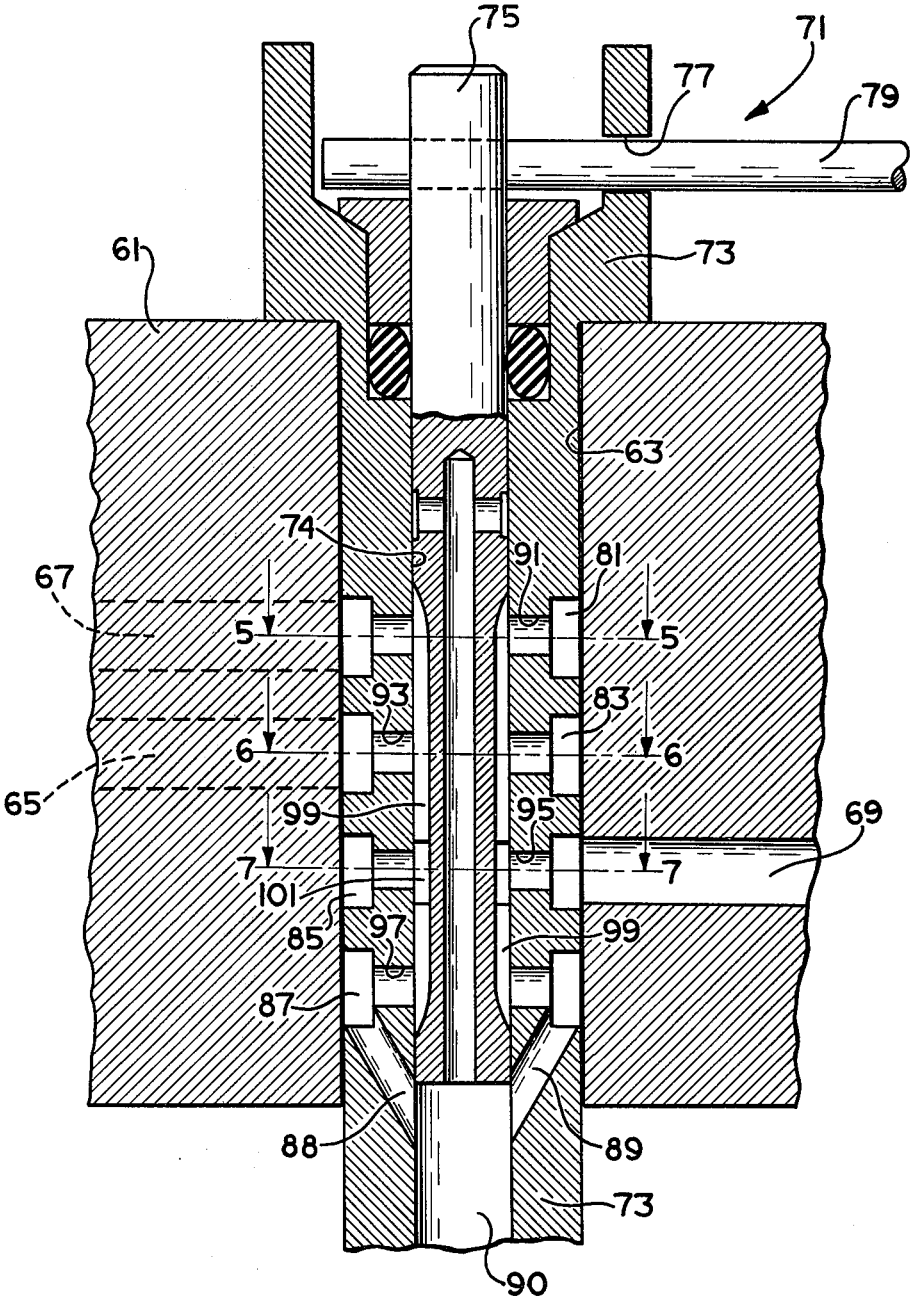
FIG. 4 is an enlarged axial cross section, similar to FIG. 3, but on a larger scale, and showing the valve spool assembly in axial cross section.
Figure 5:
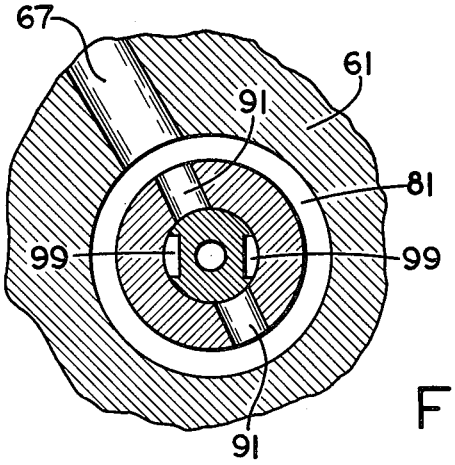
FIGS. 5, 6 and 7 are fragmentary, transverse cross sections taken on lines 5—5; 6—6; and 7—7, respectively, of FIG. 4, and on the same scale.
Figure 6:
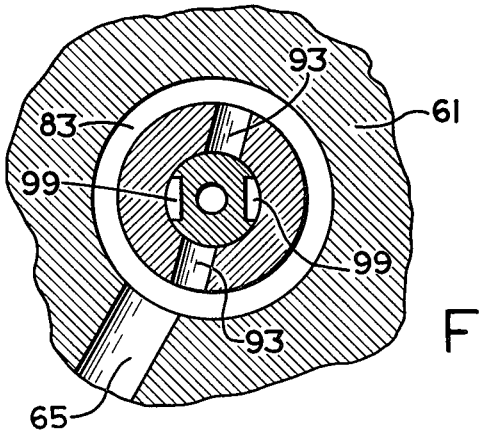
Figure 7:
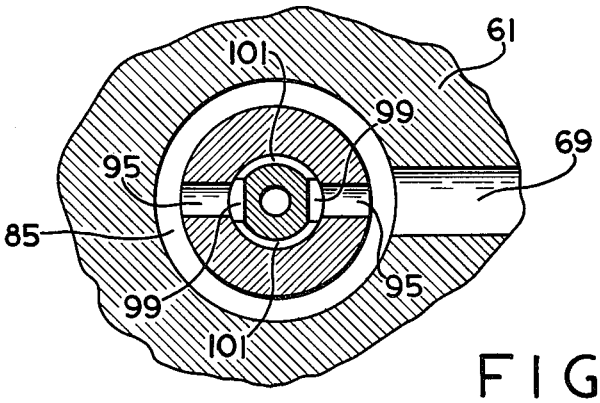

Referring now to FIG. 4, the valve spool assembly 71 which is shown in axial cross section, rather than in exterior plan view as in FIG. 3, will now be described in detail. The valve spool assembly 71 includes a valve sleeve 73 which defines a valve bore 74 and which is preferably press fit into the valve bore 63, to remain fixed relative to the valve block 61. Disposed within the valve bore 74 is a valve spool 75, shown partly in plan view in FIG. 4, and partly in axial cross section. The valve sleeve 73 defines a circumferential opening 77, and a lever member 79 projects through the opening 77 and engages the valve spool 75 to permit rotation of the valve spool 75 by movement of the lever 79.

Reference should now be made to FIGS. 2 and 5–7, in conjunction with FIG. 4, for a better understanding of the detailed description of the sleeve 73 and spool 75, as well as the various fluid paths defined. It may be seen from FIGS. 5–7 that the various radial passages defined by the valve sleeve 73 are not actually in the same axial plane, although shown in that manner in FIG. 4 for ease of illustration.

The valve sleeve 73 defines a plurality of annular grooves 81, 83, 85, and 87. Annular groove 81 is in continuous flow communication with load passage 67; annular groove 83 is in continuous fluid communication with feed passage 65; and annular groove 85 is in continuous fluid communication with the load signal passage 69. The annular groove 87 is in continuous fluid communication with the system reservoir by means of a pair of angled passages 88 and 89, and an interior passage 90 defined by the valve sleeve 73.

The valve sleeve 73 further defines pairs of diametrically opposed radial bores 91, 93, 95, and 97, communicating between the interior of the sleeve 73 and the annular grooves 81, 83, 85, and 87, respectively.

Referring still primarily to FIG. 4, the valve spool 75 defines a pair of diametrically opposed, axially-extending slots 99 which extend over a sufficient axial distance to communicate with all of the radial bores 91, 93, 95, and 97. In addition, the valve spool 75 defines an annular groove 101 (see FIG. 7), whereby the slots 99 are in continuous fluid communication, through the radial bores 95 and annular groove 85, with the load signal passage 69 and load signal port 49, regardless of the rotational position of the valve spool 75.

Operation

Referring now to FIGS. 8–12, in conjunction with FIG. 1, the operation of the present invention will be described. It should be noted that in each of FIGS. 8–12, each of the radial bores 91, 93, and 97 are shown as being in the same transverse plane, merely to illustrate the relationship of each pair of radial bores to the axial slots 99. It should be noted that the radial bores 95 are not shown in FIGS. 8–12 because, as previously described, the communication of the axial slots 99 with the load signal port 49 is continuous and unrestricted, and therefore, need not be illustrated in detail. The purpose of FIGS. 8–12 is to illustrate the sequencing of the opening and closing of the variable orifices 55, 57, and 59 shown schematically in FIG. 1.

Figure 8:
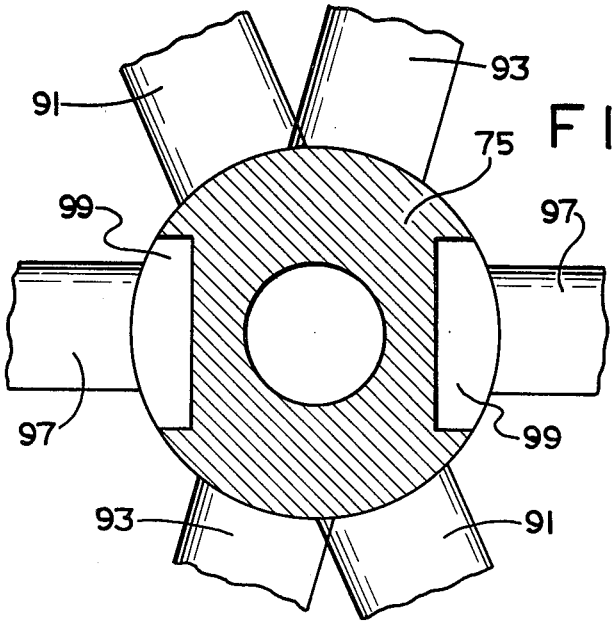
FIGS. 8–12 are views similar to FIGS. 5–7, but further enlarged, and with the various passages in the valve sleeve being shown on the same plane to illustrate the operation of the pilot control valve of the invention.

Referring now primarily to FIG. 8, there is illustrated the minimum flow position of the pilot control valve 35. In the minimum flow position, the lever member 79 and valve spool 75 are positioned such that the axial slots 99 are oriented as shown in FIG. 8 whereby the slots 99 have maximum communication with the radial bores 97, but the valve spool 75 blocks fluid communication through the radial bores 91 and 93. The flow area between the slots 99 and the radial bores 97 constitutes the variable orifice 55 of FIG. 1, while the flow area between the slots 99 and the radial bores 91 constitutes the variable orifice 59 of FIG. 1, and the flow area between the axial slots 99 and the radial bores 93 constitutes the variable orifice 57 of FIG. 1. Therefore, in the minimum flow position of FIG. 8, variable orifices 57 and 59 are closed while orifice 55 is at a maximum. See the graph in FIG. 13 of orifice area vs. valve deflection, with the different parts of the graph being labeled to correspond to the different positions of the valve spool 75 in FIGS. 8–12. In the position of FIG. 8, there is relatively unrestricted fluid communication between the load signal port 49 and the system reservoir. With the load signal 51 being at tank pressure, the valve member 27 is biased to the left in FIG. 1 by the pilot signal 53, such that almost the entire flow from the pump 15 through the inlet port 19 is directed through the excess flow outlet port 25 to the auxiliary load circuit 43. Thus, flow from the priority outlet port 23 through the pilot control valve 35 to the motor 13 is at a minimum. See the graph in FIG. 14 of flow vs. deflection. In the subject embodiment, the force exerted by the spring 29 on the valve member 27 is equivalent to 65 psi, such that, with the pilot control valve 35 in the minimum flow position of FIG. 8, the fluid pressure flowing to the motor 13 will be approximately 65 psi, and if that pressure is insufficient to operate the motor, the flow through the pilot valve 35 will for all practical purposes be zero.

Figure 9:
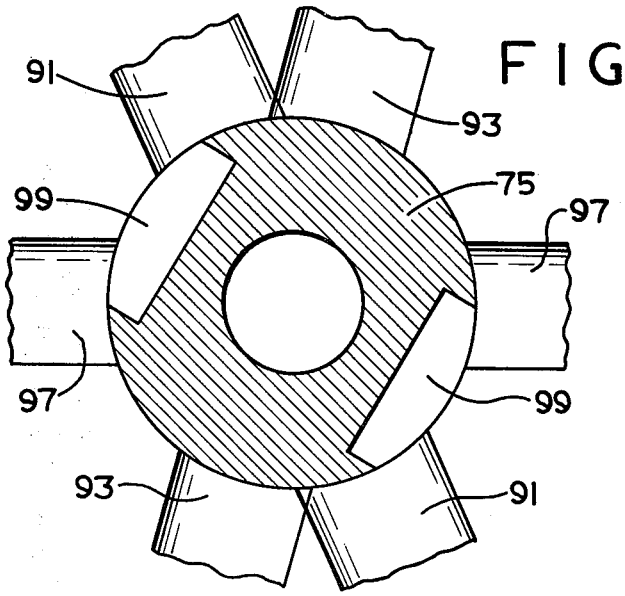

Referring now to FIG. 9, the valve spool 75 has been rotated away from the minimum flow position toward a position in which there is simultaneous communication of the slots 99 with the radial bores 91 and with the radial bores 97. As the spool 75 is rotated from the position shown in FIG. 8 toward the position shown in FIG. 9, the variable orifice 55 begins to decrease, while the variable orifice 59 begins to increase, and the variable orifice 57 remains closed. In moving toward the position shown in FIG. 9, and then beyond, the fluid pressure in the outlet port 37 (i.e., the "load" pressure), is communicated through load passage 67, through annular groove 81 and radial bores 91, then through axial slots 99 to the load signal port 49. However, at the same time, this load pressure is being partially bled off through radial bores 97 and annular groove 87 to the system reservoir, such that the pressure of the load signal 51 is somewhere between tank pressure and the actual load pressure at outlet port 37. As the pressure of the load signal 51 increases the valve member 27 begins to move to the right, gradually reducing flow from the inlet port 19 to the excess flow outlet port 25, while gradually increasing flow to the priority outlet port 23.

Figure 10:
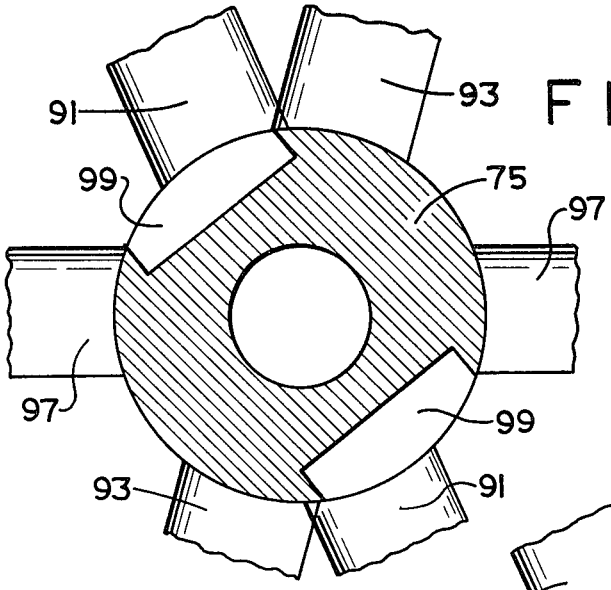

When the valve spool 75 has been rotated past the position shown in FIG. 9 to the position shown in FIG. 10, fluid communication from the slots 99 and the system reservoir through the radial bores 97 is blocked, i.e., the variable orifice 55 of FIG. 1 is now closed. At the same time, fluid communication of the slots 99 with the radial bores 91 is approaching a maximum, i.e., the variable orifice 59 of FIG. 1 is nearly wide open. As shown in FIG. 10, the slots 99 have still not yet begun to communicate with the radial bores 93 which contain fluid at the pressure of the inlet port 33, and the variable orifice 57 is still closed. When the valve spool 75 is in the position shown in FIG. 10, the pressure of the load signal 51 is the same as the pressure in the outlet port 37, because the load signal pressure present in load signal port 49 is no longer being partially bled away to the system reservoir. Because the pressure of the load signal 51 is now equal to the load pressure in the outlet port 37, the valve member 27 is moved even further to the right in FIG. 1, further reducing flow from the inlet port 19 to the excess flow outlet port 25, while further increasing flow to the priority outlet port 23.

Figure 11:
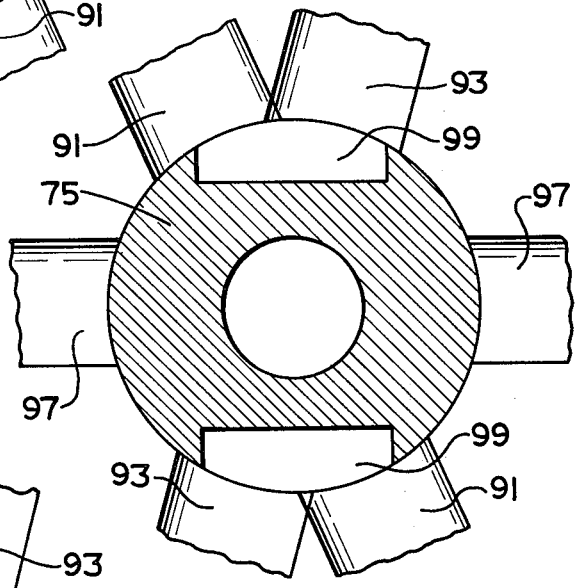

Referring now to FIG. 11, it may be seen that the valve spool 75 has been rotated even further, to a position in which the slots 99 are now in fluid communication with the radial bores 93, while still being in communication with the radial bores 91. Therefore, in the position shown in FIG. 11, fluid pressure in the load signal port 49 is somewhere between the pressure in the outlet port 37 and the somewhat higher pressure in the inlet port 33. This further increase in the pressure of the load signal 51 moves the valve member 27 even further to the right, reducing flow to the excess flow outlet port 25, while increasing flow to the priority outlet port 23. As the valve spool 75 moves toward the position shown in FIG. 11, and then beyond, the area of communication between the slots 99 and bores 93 is increasing, i.e., the variable orifice 57 of FIG. 1 is opening. At the same time, the area of communication between the slots 99 and the bores 91 is decreasing, i.e., the variable orifice 59 of FIG. 1 is closing.

Figure 12:
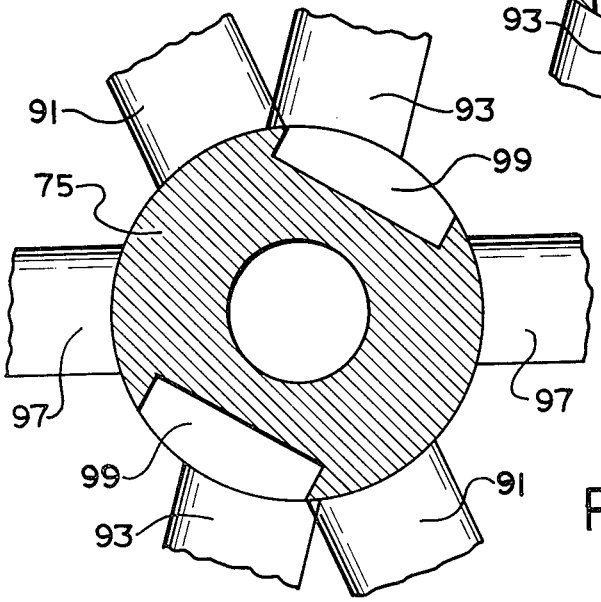
Figure 13:
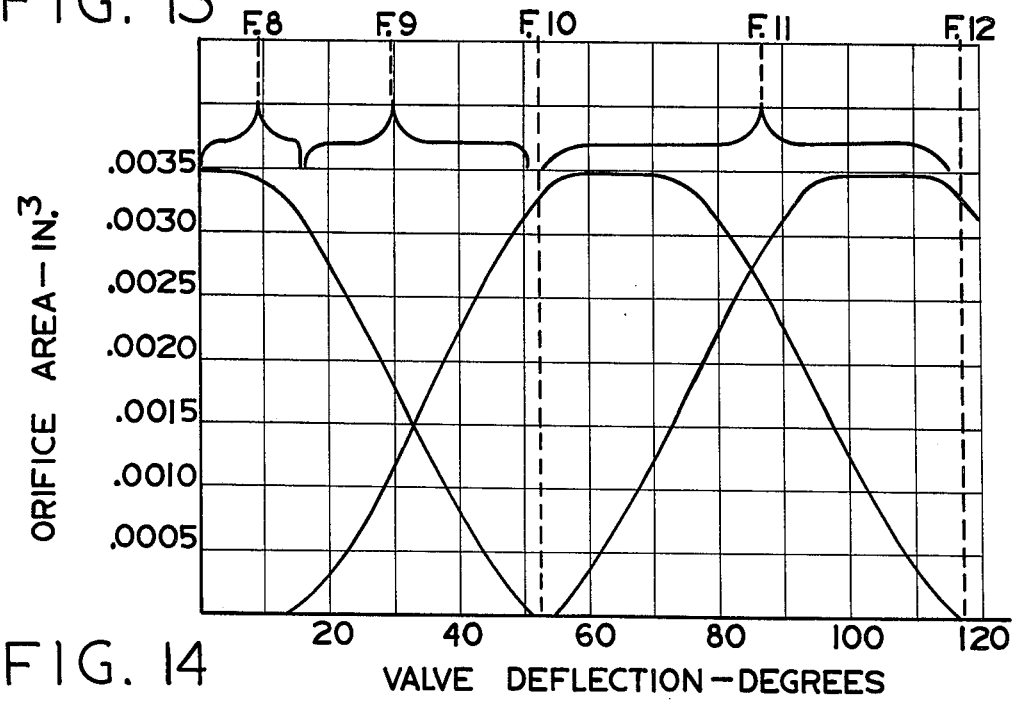
FIG. 13 is a graph of orifice area vs. valve deflection (spool rotation).

Referring now to FIG. 12, the maximum flow position of the pilot control valve 35 is illustrated. In FIG. 12, it may be seen that the valve spool 75 is rotated to a position in which the slots 99 are now out of fluid communication with the bores 91, i.e., the variable orifice 59 of FIG. 1 is now closed. At the same time, the area of communication between the slots 99 and the radial bores 93 has approached and reached its maximum, i.e., the variable orifice 57 of FIG. 1 is now fully opened. Therefore, in the position shown in FIG. 12, the fluid pressure in the load signal port 49 is substantially equal to the fluid pressure in the inlet port 33, and the load signal 51 is substantially equal to the pilot signal 53. As a result, the signals 51 and 53 approximately balance and the spring 29 biases the valve member 27 to the extreme right in FIG. 1, blocking communication from the inlet port 19 to the excess flow outlet port 25, while permitting substantially the entire system flow to pass from the inlet port 19 to the priority outlet port 23.

It may thus be seen that as the valve spool 75 is rotated progressively from the position shown in FIG. 8 to the position shown in FIG. 12, the valve member 27 progressively shifts from its extreme left position to its extreme right position in FIG. 1, such that the priority flow control valve 21 acts as the flow control valve for the motor 13. It is a special feature of the invention that the input which results in the flow control function is movement of the relatively small pilot control valve spool 75. Rotation of the valve spool 75 requires almost negligible input power, but causes, indirectly, variation of the priority flow rate from the minimum to the maximum flow rate. In the subject embodiment, the valve spool 75 is about one-eighth inch in diameter, but because of the invention, is able to control flow rates over a range of zero to forty or fifty gpm, in a precise manner.

In reviewing the positions of the valve spool 75 as shown in FIGS. 8–12, it should be clearly understood that, in the preferred embodiment of the invention, the valve spool 75 would not have five discrete positions, but would be infinitely variable between the positions shown in FIGS. 8 and 12. It should also be noted that when the valve spool 75 is in the positions shown in FIGS. 8, 10, and 12, the load signal 51 may be considered a "static" signal, i.e., the fluid which is at load signal pressure is not flowing. In FIG. 8, the load signal is at reservoir pressure; in FIG. 10, the load signal is at the pressure of the outlet port 37; and in FIG. 12, the load signal is at the pressure of the inlet port 33. However, when the valve spool 75 is in the "in between" positions represented by FIGS. 9 and 11, the load signal 51 may be considered a "dynamic" signal, i.e., the fluid at the load signal pressure is flowing. In FIG. 9, the load signal pressure is the result of flow from the oulet port 37, through the slots 99, to the system reservoir. In FIG. 11, the load signal pressure is the result of flow from the inlet port 33, through the slots 99, to the outlet port 37.

Figure 14:
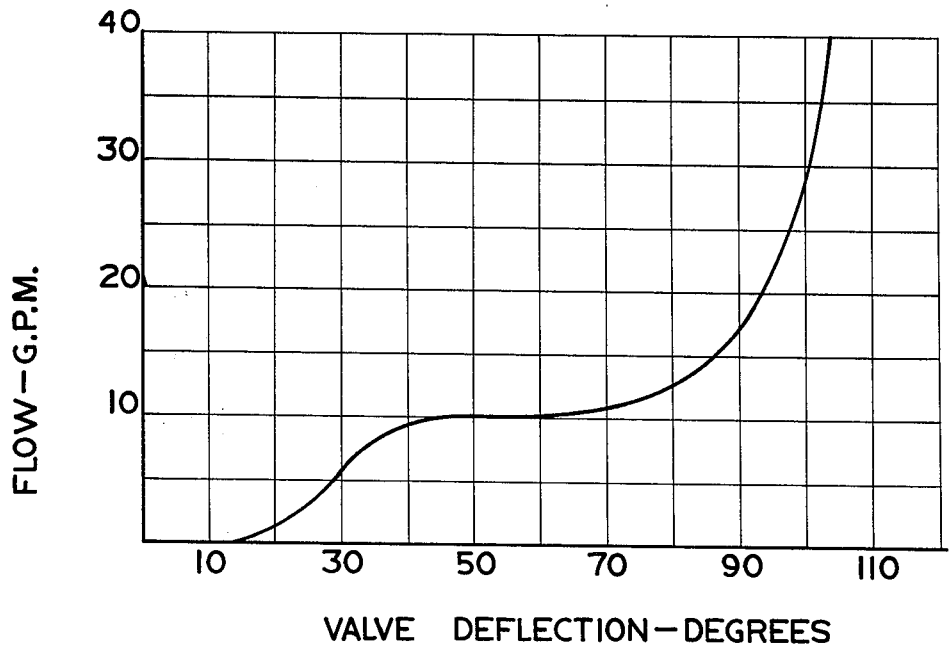
FIG. 14 is a graph of flow vs. valve deflection for the pilot control valve of the invention.

It may be seen by reference to FIG. 14 that the operation of the pilot control valve 35 of the present invention is likely to be nonlinear. However, it is believed to be within the knowledge of those skilled in the art to provide an electrically-actuated input to the valve spool 75 in which the various signals are shaped in such a manner as to compensate for the inherent nonlinearity of the valve 35. In other words, the overall system may be made to appear linear from the perspective of the operator.

In the embodiment of the invention described herein, the flow orifice 47 is illustrated as a fixed orifice. However, it is within the scope of the invention to utilize a variable orifice instead of the fixed orifice 47. In that case, it would be possible to coordinate the control of the variable orifice with the shaping circuit noted above to make the system linear. It would also be possible to use a variable orifice as a way of having two separate flow controls for the circuit. It is also considered to be within the scope of the invention to provide some type of directional controls, for example, an arrangement of on-off solenoid valves.

The present invention has been described in detail sufficient to enable one skilled in the art to practice the same. It is believed that various alterations and modifications of the invention will be come apparent to those skilled in the art upon a reading and understanding of the foregoing specification, and it is intended to include all such alterations and modifications as part of the invention, insofar as they come within the scope of the appended claims.

What is claimed is:

1. A flow control arrangement for use in a system including a fluid source having an output flow which is variable in response to changes in pressure in a load signal chamber and a flow path, including a flow orifice, connected in series flow relation with the fluid source, said flow control arrangement comprising:

(a) a valve housing defining a valve bore, a feed passage in fluid communication with the flow path, upstream of the flow orifice, a load passage in fluid communication with the flow path, downstream of the flow orifice, a load signal passage in fluid communication with the load signal chamber, and a drain passage in fluid communication with the system drain, said feed, load, load signal, and drain passages being in fluid communication with said valve bore; and (b) a movable valve member disposed in said valve bore and having a plurality of control positions, including:

(i) a first position providing a fluid communication between said drain passage and said load signal passage while blocking communication through said feed and load passages;

(ii) a second position providing simultaneous fluid communication between said load signal passage and said drain and load passages while blocking communication through said feed passage;

(iii) a third position providing communication between said load signal passage and said load passage while blocking communication through said drain and feed passages;

(iv) a fourth position providing simultaneous fluid communication between said load signal passage and said load and feed passages while blocking communication through said drain passage; and (v) a fifth position providing fluid communication between said load signal passage and said feed passage while blocking communication through said drain and load passages.

2. A flow control arrangement for use in a system including a fluid pump and a flow control valve including an inlet port in fluid communication with the pump, a priority outlet port, an excess flow outlet port in fluid communication with an auxiliary load circuit, a movable valve member, movable between one position permitting substantially unrestricted fluid communication from the inlet port to the priority outlet port, and another position permitting substantially unrestricted fluid communication from the inlet port to the excess flow outlet port, means biasing the movable valve member toward the one position, the means including a load signal, the system further including a flow path communicating between the priority outlet port and a priority fluid pressure actuated device, the flow path including a flow orifice, said flow control arrangement comprising:

(a) a valve housing defining a valve bore, a feed passage in fluid communication with the flow path, upstream of the flow orifice, a load passage in fluid communication with the flow path, downstream of the flow orifice, a load signal passage in communication with the flow control valve to provide the load signal therefor, and a drain passage in fluid communication with the system drain, said feed, load, load signal, and drain passages being in fluid communication with said valve bore; and (b) a movable valve member disposed in said valve bore and having a plurality of control positions, including (i) a first position permitting fluid communication from said load signal passage to said drain passage while preventing communication between said load signal passage and said feed and load passages;

(ii) a second position permitting fluid communication between said load signal and said drain and load passages simultaneously while preventing communication between said load signal passage and said feed passage;

(iii) a third position permitting fluid communication from said load passage to said load signal passage while preventing fluid communication between said load signal passage and said drain and feed passages;

(iv) a fourth position permitting fluid communication between said load signal passage and said load and feed passages simultaneously while preventing communication from said load signal passage to said drain passage; and (v) a fifth position permitting fluid communication from said feed passage to said load signal passage while preventing fluid communication between said load signal passage and said drain and load passages.

3. The flow control arrangement of claim 1 or 2 wherein, as said valve member moves from said first position, through said second, third, and fourth positions to said fifth position, the flow through the flow path progressively increases from a minimum flow to a maximum flow.

4. The flow control arrangement of claim 3 wherein said movable valve member comprises a rotatable valve spool defining at least one axially-extending slot in continuous fluid communication with said load signal passage.

5. The flow control arrangement of claim 4 wherein said feed passage, said load passage, and said drain passage communicate with said valve bore at axially spaced apart locations, said feed passage, said load passage, and said drain passage being circumferentially disposed relative to each other.

* * * * *